US009394093B2

(12) United States Patent
Alexander et al.

(10) Patent No.: US 9,394,093 B2
(45) Date of Patent: Jul. 19, 2016

(54) CARTON WITH DISPENSER

(71) Applicant: Graphic Packaging International, Inc., Atlanta, GA (US)

(72) Inventors: O'Neal Alexander, Covington, GA (US); Daniel Ahern, Burnsville, MN (US); Jean-Manuel Gomes, Acworth, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 56 days.

(21) Appl. No.: 13/963,214

(22) Filed: Aug. 9, 2013

(65) Prior Publication Data

US 2014/0042048 A1 Feb. 13, 2014

Related U.S. Application Data

(60) Provisional application No. 61/742,442, filed on Aug. 10, 2012.

(51) Int. Cl.
*B65D 71/34* (2006.01)
*B65D 71/30* (2006.01)
(Continued)

(52) U.S. Cl.
CPC . *B65D 71/34* (2013.01); *B31B 1/26* (2013.01); *B31B 1/86* (2013.01); *B31B 1/90* (2013.01); *B65B 5/024* (2013.01); *B65D 5/46* (2013.01);
(Continued)

(58) Field of Classification Search
CPC ..... B65D 5/6623; B65D 5/72; B65D 5/725; B65D 5/743; B65D 5/54; B65D 5/541; B65D 5/544; B65D 5/542
USPC ..... 206/427; 229/122, 200, 240–242
See application file for complete search history.

(56) References Cited

U.S. PATENT DOCUMENTS 902,347 A 10/1908 Tillinghast
1,541,143 A 6/1925 Hoile
(Continued)

FOREIGN PATENT DOCUMENTS

CA 873 185 6/1971
DE 2 323 589 11/1974
(Continued)

OTHER PUBLICATIONS

International Search Report and Written Opinion for PCT/US2013/054285 dated Oct. 17, 2013.
(Continued)

*Primary Examiner* — Anthony Stashick
*Assistant Examiner* — Robert Poon
(74) *Attorney, Agent, or Firm* — Womble Carlyle Sandridge & Rice, LLP

(57) ABSTRACT

A carton for containing a plurality of articles. The carton comprises a plurality of panels that extends at least partially around an interior of the carton. The plurality of panels comprises a top panel, a bottom panel, a first side panel, and a second side panel. At least two end flaps can be respectively foldably attached to respective panels of the plurality of panels. The at least two end flaps are at least partially overlapped with respect to one another and thereby at least partially form a closed end of the carton. The closed end of the carton can comprise a generally vertical portion extending from the bottom panel and an oblique portion extending from the top panel to the generally vertical portion. A dispenser can extend in at least the closed end of the carton.

18 Claims, 5 Drawing Sheets

(51) Int. Cl.

| | |
|---|---|
| ***B65D 5/46*** | (2006.01) |
| ***B65D 5/54*** | (2006.01) |
| ***B31B 1/26*** | (2006.01) |
| ***B31B 1/86*** | (2006.01) |
| ***B31B 1/90*** | (2006.01) |
| ***B65B 5/02*** | (2006.01) |
| ***B65D 71/36*** | (2006.01) |
| ***B65D 5/468*** | (2006.01) |

(52) U.S. Cl.

CPC ..... *B65D 5/4608* (2013.01); *B65D 5/541* (2013.01); *B65D 5/542* (2013.01); *B65D 71/30* (2013.01); *B65D 71/36* (2013.01); *B65D 2571/0045* (2013.01); *B65D 2571/0058* (2013.01); *B65D 2571/0066* (2013.01); *B65D 2571/00141* (2013.01); *B65D 2571/00561* (2013.01); *B65D 2571/00728* (2013.01)

(56) References Cited

U.S. PATENT DOCUMENTS

| | | | |
|---|---|---|---|
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,299,027 | A | 10/1942 | Novak |
| 2,669,351 | A | 2/1954 | Carson et al. |
| 2,718,301 | A | 9/1955 | Palmer |
| 2,723,027 | A | 11/1955 | Guyer |
| 2,754,047 | A | 7/1956 | Schmidt et al. |
| 2,842,304 | A | 7/1958 | Ringler |
| 2,868,431 | A | 1/1959 | Painter |
| 2,930,516 | A | 3/1960 | Fowle et al. |
| 2,975,891 | A | 3/1961 | Stone |
| 2,990,097 | A | 6/1961 | Thompson |
| 3,002,651 | A | 10/1961 | Gauld |
| 3,018,031 | A | 1/1962 | Ahlbor et al. |
| 3,078,032 | A | 2/1963 | Robinson et al. |
| 3,128,010 | A | 4/1964 | Forrer |
| 3,133,634 | A | 5/1964 | Bozdar |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| RE26,083 | E | 9/1966 | Forrer |
| 3,300,115 | A | 1/1967 | Schauer |
| 3,332,594 | A | 7/1967 | De Capua |
| 3,346,167 | A | 10/1967 | Schmidt |
| 3,356,279 | A | 12/1967 | Root |
| 3,517,858 | A | 6/1970 | Farquhar |
| 3,533,549 | A | 10/1970 | Gilchrist |
| 3,540,581 | A | 11/1970 | Koolnis |
| 3,599,858 | A | 8/1971 | Samsing |
| 3,669,251 | A | 6/1972 | Phillips |
| 3,765,527 | A | 10/1973 | Vargo |
| 3,894,681 | A | 7/1975 | Arneson et al. |
| 3,913,739 | A | 10/1975 | Hennessey |
| 3,942,631 | A | 3/1976 | Sutherland et al. |
| 4,000,811 | A | 1/1977 | Hardison et al. |
| D243,508 | S | 3/1977 | Killy |
| 4,030,596 | A | 6/1977 | Snyder et al. |
| 4,066,207 | A | 1/1978 | Jorgensen-Beck et al. |
| 4,155,449 | A | 5/1979 | Bryne |
| D252,259 | S | 7/1979 | Rinehart |
| 4,214,660 | A | 7/1980 | Hunt, Jr. |
| 4,222,485 | A | 9/1980 | Focke |
| 4,256,226 | A | 3/1981 | Stone |
| D263,204 | S | 3/1982 | Dutcher |
| 4,318,474 | A | 3/1982 | Hasegawa |
| 4,325,482 | A | 4/1982 | Feeser |
| 4,364,509 | A | 12/1982 | Holley, Jr. et al. |
| 4,375,258 | A | 3/1983 | Crayne et al. |
| 4,376,509 | A | 3/1983 | Schaffer |
| 4,378,877 | A | 4/1983 | Botterman et al. |
| D269,068 | S | 5/1983 | Mann et al. |
| D270,041 | S | 8/1983 | Vestal |
| 4,396,143 | A | 8/1983 | Killy |
| 4,416,410 | A | 11/1983 | Herrmann |
| 4,417,655 | A | 11/1983 | Forbes, Jr. |
| 4,417,661 | A | 11/1983 | Roccaforte |
| 4,498,581 | A | 2/1985 | Dutcher |
| 4,577,762 | A | 3/1986 | Kuchenbecker |
| 4,582,199 | A | 4/1986 | Schuster |
| 4,605,128 | A | 8/1986 | Rieke |
| D286,987 | S | 12/1986 | Golan et al. |
| 4,658,984 | A | 4/1987 | Brunner |
| 4,726,471 | A | 2/1988 | Whately et al. |
| 4,785,991 | A | 11/1988 | Schuster |
| 4,817,866 | A | 4/1989 | Wonnacott |
| D303,090 | S | 8/1989 | Armor et al. |
| 4,860,944 | A | 8/1989 | Wonnacott |
| 4,890,440 | A | 1/1990 | Romagnoli |
| 4,919,266 | A | 4/1990 | McIntosh, Jr. et al. |
| 4,949,845 | A | 8/1990 | Dixon |
| 4,966,324 | A | 10/1990 | Steel |
| 4,972,991 | A | 11/1990 | Schuster |
| 4,974,771 | A | 12/1990 | Lavery |
| 4,981,253 | A | 1/1991 | Quaintance |
| 5,002,186 | A | 3/1991 | Cooper |
| 5,031,825 | A | 7/1991 | Romagnoli |
| 5,067,615 | A | 11/1991 | Davitian |
| 5,101,642 | A | 4/1992 | Alexandrov |
| 5,123,589 | A | 6/1992 | Cote |
| 5,137,211 | A | 8/1992 | Summer et al. |
| 5,170,934 | A | 12/1992 | Lemoine |
| D332,915 | S | 2/1993 | Hoell et al. |
| 5,219,229 | A | 6/1993 | Sengewald |
| 5,249,681 | A | 10/1993 | Miller |
| 5,277,360 | A | 1/1994 | DeMott |
| 5,279,440 | A | 1/1994 | Fougeres et al. |
| 5,284,292 | A | 2/1994 | Johnson |
| 5,368,194 | A | 11/1994 | Oliff et al. |
| 5,425,474 | A | 6/1995 | Dalea et al. |
| 5,427,242 | A | 6/1995 | Oliff et al. |
| 5,465,831 | A | 11/1995 | Smith |
| 5,482,185 | A | 1/1996 | McNaughton |
| 5,505,372 | A | 4/1996 | Edson et al. |
| 5,518,111 | A | 5/1996 | Stout |
| 5,577,612 | A | 11/1996 | Chesson et al. |
| 5,597,114 | A | 1/1997 | Kramedjian et al. |
| 5,622,309 | A | 4/1997 | Matsuda et al. |
| 5,664,683 | A | 9/1997 | Brody |
| 5,690,213 | A | 11/1997 | Matsumura |
| 5,690,230 | A | 11/1997 | Griffith |
| 5,722,584 | A | 3/1998 | Fujiwara |
| 5,775,574 | A | 7/1998 | Whitnell |
| 5,794,778 | A | 8/1998 | Harris |
| 5,826,783 | A | 10/1998 | Stout |
| 5,833,118 | A | 11/1998 | Weiss |
| 5,873,515 | A | 2/1999 | Dunn et al. |
| 5,875,961 | A | 3/1999 | Stone et al. |
| 5,878,947 | A | 3/1999 | Hoy et al. |
| 5,881,884 | A | 3/1999 | Podosek |
| 5,921,398 | A | 7/1999 | Carroll |
| 5,924,559 | A | 7/1999 | Carrel et al. |
| 5,927,498 | A | 7/1999 | Saam |
| 6,050,402 | A | 4/2000 | Walter |
| 6,105,854 | A | 8/2000 | Spivey et al. |
| 6,123,222 | A | 9/2000 | Richiger et al. |
| D436,859 | S | 1/2001 | Botsford et al. |
| 6,176,419 | B1 | 1/2001 | Holley, Jr. |
| 6,283,293 | B1 | 9/2001 | Lingamfelter |
| D454,784 | S | 3/2002 | Oram |
| 6,386,369 | B2 | 5/2002 | Yuhas et al. |
| 6,409,077 | B1 | 6/2002 | Telesca et al. |
| D459,927 | S | 7/2002 | Flowers et al. |
| 6,435,351 | B1 | 8/2002 | Gibb |
| 6,478,219 | B1 | 11/2002 | Holley, Jr. |
| 6,484,903 | B2 | 11/2002 | Spivey et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |

(56) References Cited

U.S. PATENT DOCUMENTS

| | | | | |
|---|---|---|---|---|
| 6,631,803 | B2 | 10/2003 | Rhodes et al. | |
| 6,669,083 | B2 | 12/2003 | Bates | |
| 6,715,639 | B2 | 4/2004 | Spivey | |
| 6,752,262 | B1 | 6/2004 | Boriani et al. | |
| 6,789,673 | B2 | 9/2004 | Lingamfelter | |
| 6,866,185 | B2 | 3/2005 | Harrelson | |
| 6,866,186 | B2 | 3/2005 | Fogle et al. | |
| 6,902,104 | B2 | 6/2005 | Holley, Jr. et al. | |
| 6,918,487 | B2 | 7/2005 | Harrelson | |
| 6,929,172 | B2 | 8/2005 | Bates et al. | |
| 6,959,857 | B2 * | 11/2005 | Bates | 229/122.1 |
| 6,968,992 | B2 | 11/2005 | Schuster | |
| 6,969,172 | B2 | 11/2005 | Actis-Datta | |
| 6,974,072 | B2 | 12/2005 | Harrelson | |
| 6,991,107 | B2 | 1/2006 | Harrelson | |
| 6,997,316 | B2 | 2/2006 | Sutherland | |
| 7,000,803 | B2 | 2/2006 | Miller | |
| 7,073,665 | B2 | 7/2006 | Auclair et al. | |
| 7,104,435 | B2 | 9/2006 | Holley, Jr. | |
| 7,134,593 | B2 | 11/2006 | Harrelson | |
| 7,207,474 | B2 | 4/2007 | Holley, Jr. | |
| 7,225,930 | B2 | 6/2007 | Ford et al. | |
| 7,237,674 | B2 | 7/2007 | Auclair | |
| 7,568,612 | B2 | 8/2009 | Ho Fung et al. | |
| 7,604,157 | B2 | 10/2009 | Zammit et al. | |
| 7,614,497 | B2 | 11/2009 | Spivey, Sr. | |
| 7,658,317 | B2 | 2/2010 | Wilkins | |
| 7,699,163 | B2 | 4/2010 | Gomes et al. | |
| 7,703,666 | B2 | 4/2010 | Hand et al. | |
| 7,743,972 | B2 | 6/2010 | Fogle | |
| 7,762,394 | B2 | 7/2010 | Bradford et al. | |
| 7,870,994 | B2 | 1/2011 | Spivey, Sr. et al. | |
| 7,909,235 | B2 | 3/2011 | Holley, Jr. | |
| 7,918,384 | B2 | 4/2011 | Gomes et al. | |
| 7,966,789 | B2 | 6/2011 | Hand et al. | |
| 7,992,765 | B2 | 8/2011 | Brand | |
| 8,118,212 | B2 | 2/2012 | Miller | |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2002/0185527 | A1 | 12/2002 | Bates | |
| 2003/0141313 | A1 | 7/2003 | Bates | |
| 2003/0141353 | A1 | 7/2003 | Wilson | |
| 2003/0150759 | A1 | 8/2003 | White, Jr. | |
| 2003/0192907 | A1 | 10/2003 | Bates | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2004/0232214 | A1 * | 11/2004 | Bates | 229/122.1 |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0189405 | A1 | 9/2005 | Gomes et al. | |
| 2006/0054522 | A1 | 3/2006 | Kline et al. | |
| 2006/0091193 | A1 | 5/2006 | DeBusk et al. | |
| 2006/0118606 | A1 | 6/2006 | Holley, Jr. et al. | |
| 2006/0131370 | A1 | 6/2006 | Bates | |
| 2006/0169755 | A1 | 8/2006 | Spivey, Sr. | |
| 2006/0175386 | A1 | 8/2006 | Holley, Jr. et al. | |
| 2007/0080199 | A1 | 4/2007 | Sutherland | |
| 2007/0164093 | A1 | 7/2007 | Spivey, Sr. et al. | |
| 2007/0210144 | A1 * | 9/2007 | Brand | 229/122.1 |
| 2009/0095799 | A1 | 4/2009 | Garner | |
| 2010/0147933 | A1 | 6/2010 | Blin | |
| 2012/0138667 | A1 | 6/2012 | Burke et al. | |
| 2012/0145775 | A1 | 6/2012 | Miller | |
| 2012/0211552 | A1 | 8/2012 | Kastanek et al. | |
| 2013/0134211 | A1 | 5/2013 | Linkel | |

FOREIGN PATENT DOCUMENTS

| | | | |
|---|---|---|---|
| DE | 75 10 538 | | 8/1975 |
| DE | 76 06 493 | | 6/1976 |
| DE | 29 33 022 | | 2/1980 |
| DE | 30 07 769 | | 9/1981 |
| DE | 81 35 176 | | 5/1982 |
| DE | 85 14 718.4 | | 6/1985 |
| DE | 86 29 664.7 | | 5/1987 |
| DE | 3612594 | | 10/1987 |
| DE | 40 23 043 | | 12/1991 |
| DE | 94 12 885 | | 10/1994 |
| DE | 94 13 813 | | 10/1994 |
| DE | 295 19 931 | | 2/1996 |
| DE | 296 02 010 | | 3/1996 |
| DE | 299 09 008 | | 3/1999 |
| DE | 299 13 585 | | 10/1999 |
| DE | 694 21 620 | | 4/2000 |
| DE | 202 05 720 | U1 | 10/2002 |
| EP | 0 066 029 | | 12/1982 |
| EP | 0 235 852 | | 9/1987 |
| EP | 0 323 596 | | 7/1989 |
| EP | 0 342 088 | | 11/1989 |
| EP | 0 373 746 | | 6/1990 |
| EP | 0 475 147 | | 3/1992 |
| EP | 0 752 370 | | 1/1997 |
| EP | 0 849 189 | | 6/1998 |
| EP | 1 060 998 | | 12/2000 |
| EP | 1 637 461 | | 3/2006 |
| FR | 2 549 010 | | 1/1985 |
| GB | 2 264 101 | | 8/1993 |
| GB | 0 202 809 | | 2/2002 |
| JP | 2002-068176 | A | 3/2002 |
| WO | WO 88/09750 | | 12/1988 |
| WO | WO 91/04915 | | 4/1991 |
| WO | WO 95/01284 | | 1/1995 |
| WO | WO 95/25668 | | 9/1995 |
| WO | WO 96/29260 | | 9/1996 |
| WO | WO 97/21607 | | 6/1997 |
| WO | WO 98/31593 | | 7/1998 |
| WO | WO 98/38099 | | 9/1998 |
| WO | WO 99/64301 | | 12/1999 |
| WO | WO 00/03937 | | 1/2000 |
| WO | WO 00/23334 | | 4/2000 |
| WO | WO 00/71428 | | 11/2000 |
| WO | WO 01/28871 | | 4/2001 |
| WO | WO 02/04302 | | 1/2002 |
| WO | WO 02/47990 | | 6/2002 |
| WO | WO 02/085739 | | 10/2002 |
| WO | WO 2004/043790 | | 5/2004 |
| WO | WO 2005/051781 | | 6/2005 |
| WO | WO 2006/050210 | | 5/2006 |
| WO | WO 2006/050316 | | 5/2006 |

OTHER PUBLICATIONS

Supplementary European Search Report for EP 13 82 7533 dated Mar. 17, 2016.

* cited by examiner

CARTON WITH DISPENSER

CROSS-REFERENCE TO RELATED APPLICATIONS

This application claims the benefit of U.S. Provisional Patent Application No. 61/742,442, filed Aug. 10, 2012.

INCORPORATION BY REFERENCE

The disclosure of U.S. Provisional Patent Application No. 61/742,442, which was filed on Aug. 10, 2012, is hereby incorporated by reference for all purposes as if presented herein in its entirety.

BACKGROUND OF THE DISCLOSURE

The present disclosure generally relates to cartons for holding and dispensing articles.

SUMMARY OF THE DISCLOSURE

In general, one aspect of the disclosure is directed to a carton for containing a plurality of articles. The carton comprises a plurality of panels that extends at least partially around an interior of the carton. The plurality of panels comprises a top panel, a bottom panel, a first side panel, and a second side panel. At least two end flaps can be respectively foldably attached to respective panels of the plurality of panels. The at least two end flaps are at least partially overlapped with respect to one another and thereby at least partially form a closed end of the carton. The closed end of the carton can comprise a generally vertical portion extending from the bottom panel and an oblique portion extending from the top panel to the generally vertical portion. A dispenser can extend in at least the closed end of the carton.

In another aspect, the disclosure is generally directed to a blank for forming a carton for containing a plurality of articles. The blank comprises a plurality of panels comprising a top panel, a bottom panel, a first side panel, and a second side panel. At least two end flaps can be respectively foldably attached to respective panels of the plurality of panels. The at least two end flaps are for being at least partially overlapped with respect to one another and thereby at least partially form a closed end of the carton formed from the blank. The closed end of the carton can comprise a generally vertical portion extending from the bottom panel and an oblique portion extending from the top panel to the generally vertical portion when the carton is formed from the blank. Dispenser features for forming a dispenser can extend in at least the closed end of the carton when the carton is formed from the blank.

In another aspect, the disclosure is generally directed to a method for forming a carton for containing a plurality of articles. The method comprises obtaining a blank comprising a plurality of panels comprising a top panel, a bottom panel, a first side panel, and a second side panel, at least two end flaps respectively foldably attached to respective panels of the plurality of panels, and dispenser features in the at least two end flaps. The method further can comprise forming an interior of the carton at least partially defined by the plurality of panels. The forming the interior of the carton can comprise forming an open-ended sleeve. The method also can comprise at least partially overlapping the at least two end flaps with respect to one another to at least partially form a closed end of the carton. The forming the closed end of the carton can comprise forming a generally vertical portion extending from the bottom panel and forming an oblique portion extending from the top panel to the generally vertical portion. The method further can comprise forming a dispenser in the closed end of the carton from the dispenser features.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure generally relates to cartons housing a plurality of articles and a dispenser in the carton for removing articles from the carton. The present disclosure can be used, for example, in cartons that contain articles or other products such as, for example, food and beverages or pet food. The articles can also include soup cans or other food or beverage containers such as, for example, cans, bottles, PET containers, or other containers such as those used in packaging foodstuffs. For the purposes of illustration and not for the purpose of limiting the scope of the present disclosure, the following detailed description describes generally cylindrical beverage containers as disposed within the carton embodiments. In this specification, the relative terms "lower," "bottom," "upper," and "top" indicate relative orientations determined in relation to fully erected cartons.

Figure 1:
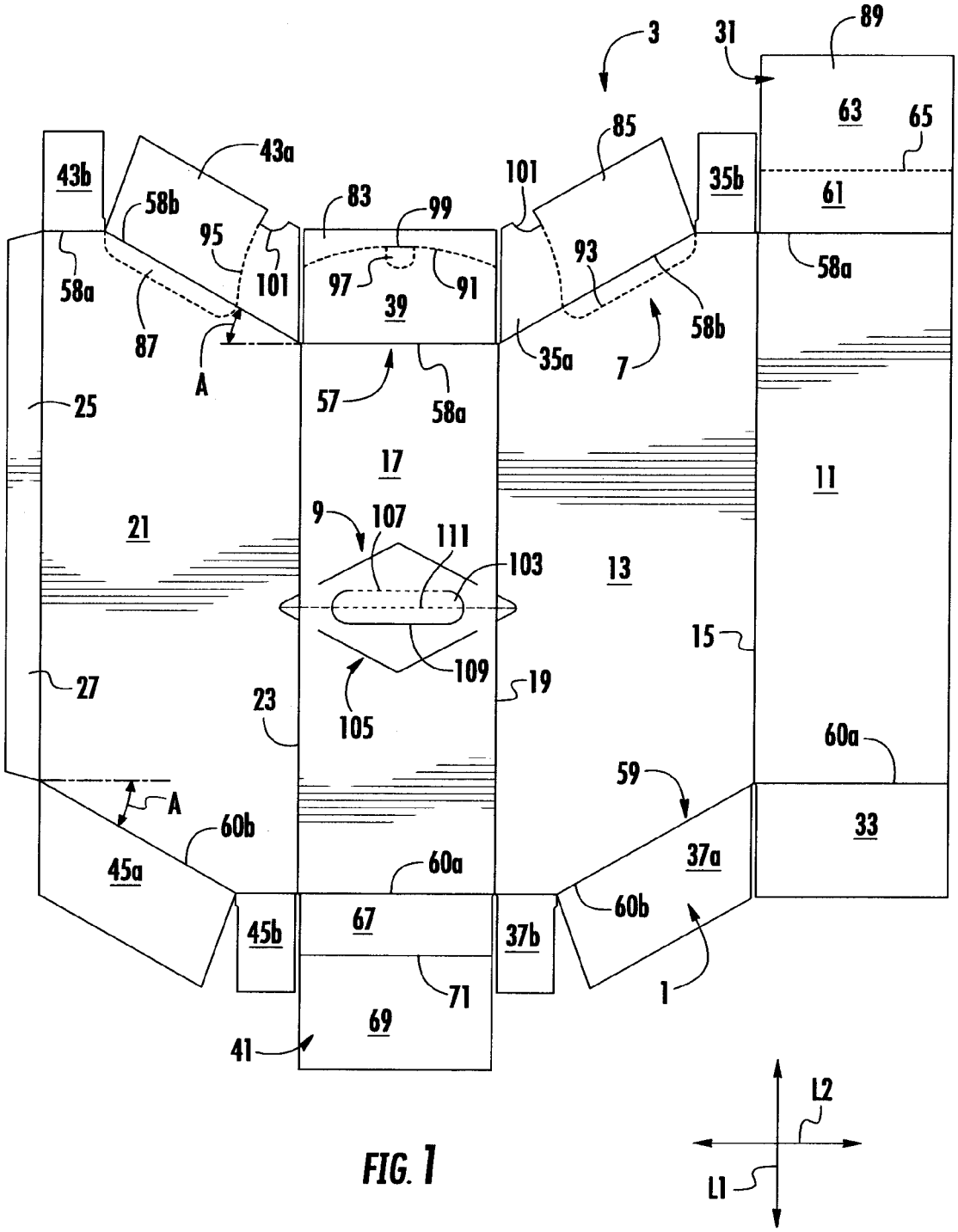
FIG. 1 is an exterior plan view of a blank for forming a carton according to an exemplary embodiment of the disclosure.
Figure 2:
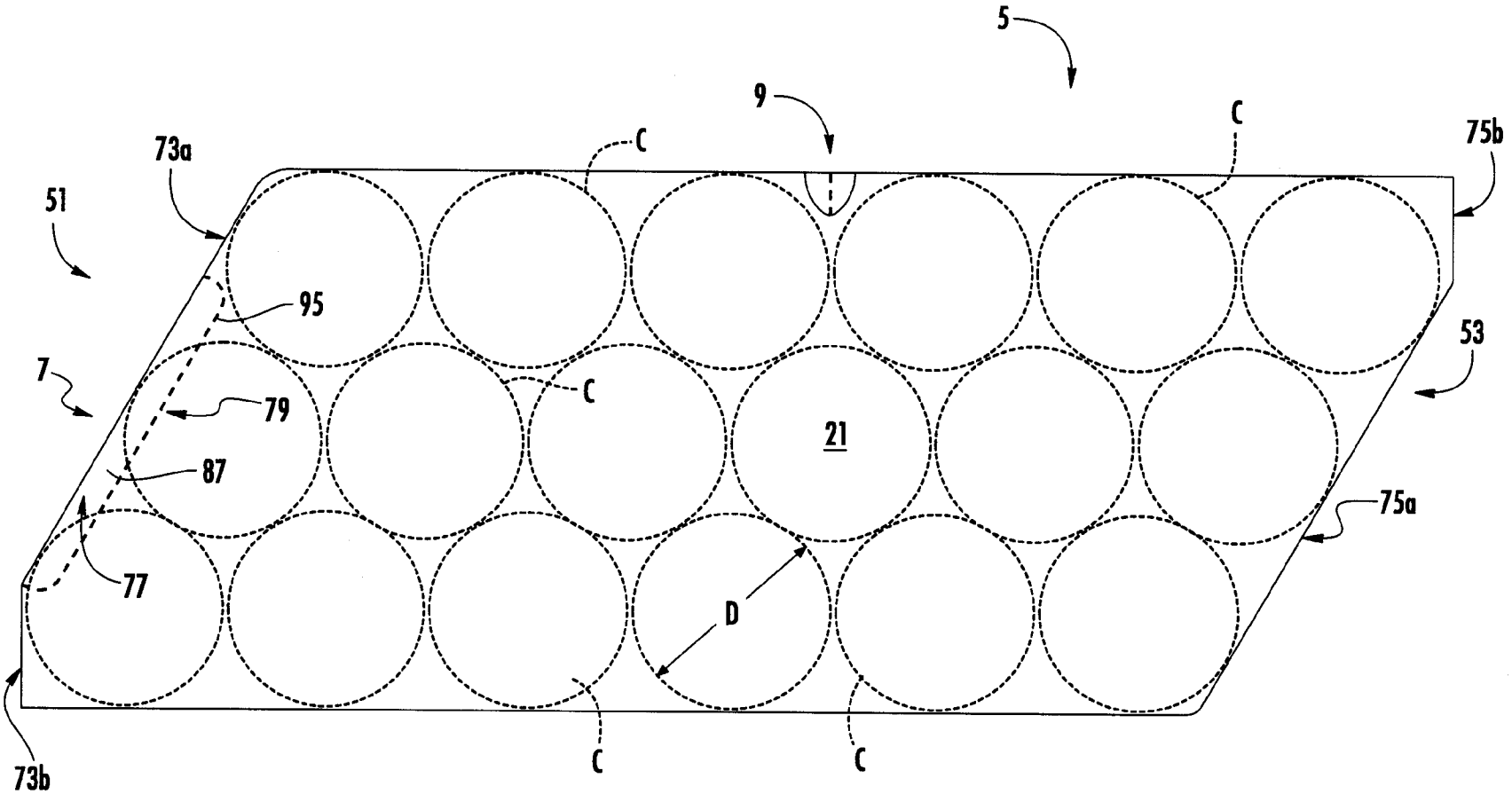
FIG. 2 is a side view of the carton formed from the blank of FIG. 1.
Figure 5:
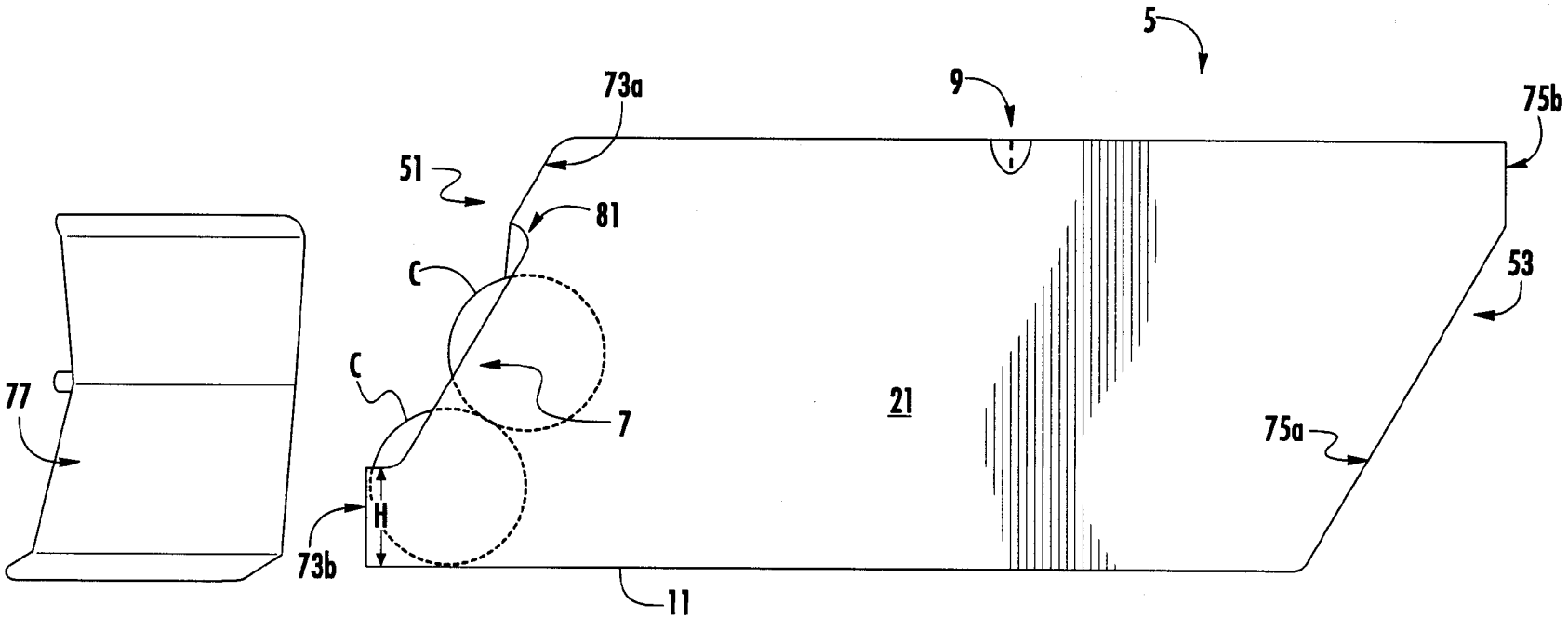
FIG. 5 is a side view of the carton of FIG. 2 showing a dispenser opening and a removed dispenser panel according to the exemplary embodiment of the disclosure.

FIG. 1 is a plan view of the exterior side 1 of a blank, generally indicated at 3, used to form a carton 5 (FIGS. 2 and 3) according to the exemplary embodiment of the disclosure. The carton 5 can be used to house a plurality of articles such as containers C (FIGS. 2 and 5). In one embodiment, the containers C can include a cylindrical beverage can (e.g., an aluminum can) with a characteristic dimension (e.g., diameter D) as shown in FIGS. 2 and 5. In the illustrated embodiment, the carton 5 is sized to hold eighteen containers C arranged in a single layer in a 3×6 arrangement, but it is understood that the carton 5 may be sized and shaped to hold containers C of a different or same quantity in more than one layer and/or in different row/column arrangements (e.g., 1×12, 2×6, 2×6×2, 3×4×2, etc.). In the illustrated embodiment, the carton 5 has a dispenser, generally indicated at 7, formed in the carton for allowing access to the containers C and a handle 9 for grasping and carrying the carton 5 from the top.

The blank 3 has a longitudinal axis L1 and a lateral axis L2. In the illustrated embodiment, the blank 3 comprises a bottom panel 11 foldably connected to a first side panel 13 at a first longitudinal fold line 15, a top panel 17 foldably connected to the first side panel 13 at a second longitudinal fold line 19, and a second side panel 21 foldably connected to the top panel 17 at a third longitudinal fold line 23. An attachment flap 25 is foldably connected to the second side panel 21 at a fourth longitudinal fold line 27.

In one embodiment, the bottom panel 11 is foldably connected to a first bottom end flap 31 and a second bottom end flap 33. The first side panel 13 is foldably connected to a first major side end flap 35*a*, a first minor side end flap 35*b*, a second major side end flap 37*a*, and a second minor side end flap 37*b*. The top panel 17 is foldably connected to a first top end flap 39 and a second top end flap 41. The second side panel 21 is foldably connected to a first major side end flap 43*a*, a first minor side end flap 43*b*, a second major side end flap 45*a*, and a second minor side end flap 45*b*. When the carton 5 is erected, the top and bottom end flaps 39, 31, major side end flaps 35*a*, 43*a*, and minor side end flaps 35*b*, 43*b* close a first end 51 of the carton, and the top and bottom end flaps 41, 33, major side end flaps 37*a*, 45*a*, and minor side end flaps 37*b*, 45*b* close a second end 53 of the carton. In accordance with an alternative embodiment of the present disclosure, different flap arrangements can be used for closing the ends 51, 53 of the carton.

As shown in FIG. 1, the end flaps 31, 35*a*, 35*b*, 39, 43*a*, 43*b* extend along a first marginal area of the blank 3, and can be foldably connected at a first fold line 57 that extends along the width of the blank. The top and bottom end flaps 39, 31 and the minor side end flaps 35*b*, 43*b* are foldably connected to the respective panels 17, 11, 13, 21 along respective lateral segments 58*a* of the first fold line 57. The major side end flaps 35*a*, 43*a* are foldably connected to the respective side panels 13, 21 along respective oblique segments 58*b* of the first fold line 57. The end flaps 33, 37*a*, 37*b*, 41, 45*a*, 45*b* extend along a second marginal area of the blank 3, and can be foldably connected at a second fold line 59 that also extends along the width of the blank. The top and bottom end flaps 41, 33 and the minor side end flaps 37*b*, 45*b* are foldably connected to the respective panels 17, 11, 13, 21 along respective lateral segments 60*a* of the second fold line 59. The major side end flaps 37*a*, 45*a* are foldably connected to the respective side panels 13, 21 along respective oblique segments 60*b* of the second fold line 59. In one embodiment, the oblique segments 58*b*, 60*b* extend at angle A of approximately 30 degrees. Alternatively, the angle A could be any suitable angle. The lateral fold lines 57, 59 may be, for example, substantially straight or offset at one or more locations to account for blank thickness or for other factors. The blank 3 could have other end flap arrangements without departing from the disclosure.

As shown in FIG. 1, the bottom end flap 31 includes a proximal portion 61 foldably connected to a distal portion 63 along a lateral tear line 65, and the top end flap 41 includes a proximal portion 67 foldably connected to a distal portion 69 along a lateral fold line 71. As shown in FIG. 2, the top end flap 39, major end flaps 35*a*, 43*a*, and the distal portion 63 of the bottom end flap 31 form an oblique portion 73*a* of the first end 51, and the minor end flaps 35*b*, 43*b* and the proximal portion 61 of the bottom end flap 31 form a lower portion 73*a* of the first end 51. The bottom end flap 33, major end flaps 37*a*, 45*a*, and the distal portion 69 of the top end flap 41 form an oblique portion 75*a* of the second end 53, and the minor end flaps 37*b*, 45*b* and the proximal portion 67 of the top end flap 41 form an upper portion 75*b* of the second end 53 (FIG. 2). The end flaps 31, 33, 35*a*, 35*b*, 37*a*, 37*b*, 39, 41, 43*a*, 43*b*, 45*a*, 45*b* and the closed ends 51, 53 of the carton could be otherwise shaped, arranged, configured, and/or omitted without departing from the disclosure. For example, in the illustrated embodiment, the lateral tear line 65 is part of the dispenser 7, described below; however, the line 65 alternatively could be a score, a crease, or another fold line without departing from the disclosure.

Figure 3:
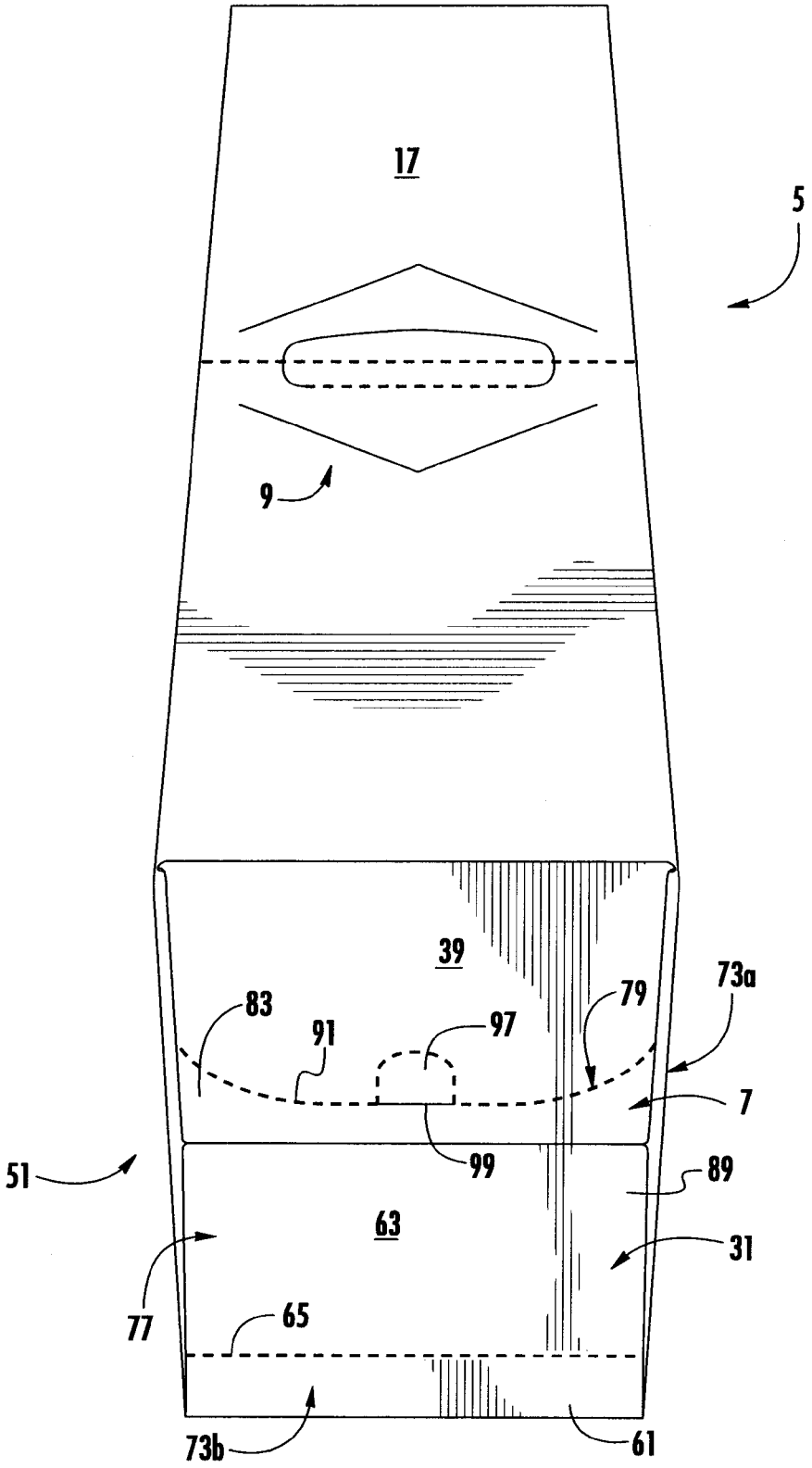
FIG. 3 is a perspective view of the carton of FIG. 2.
Figure 4:
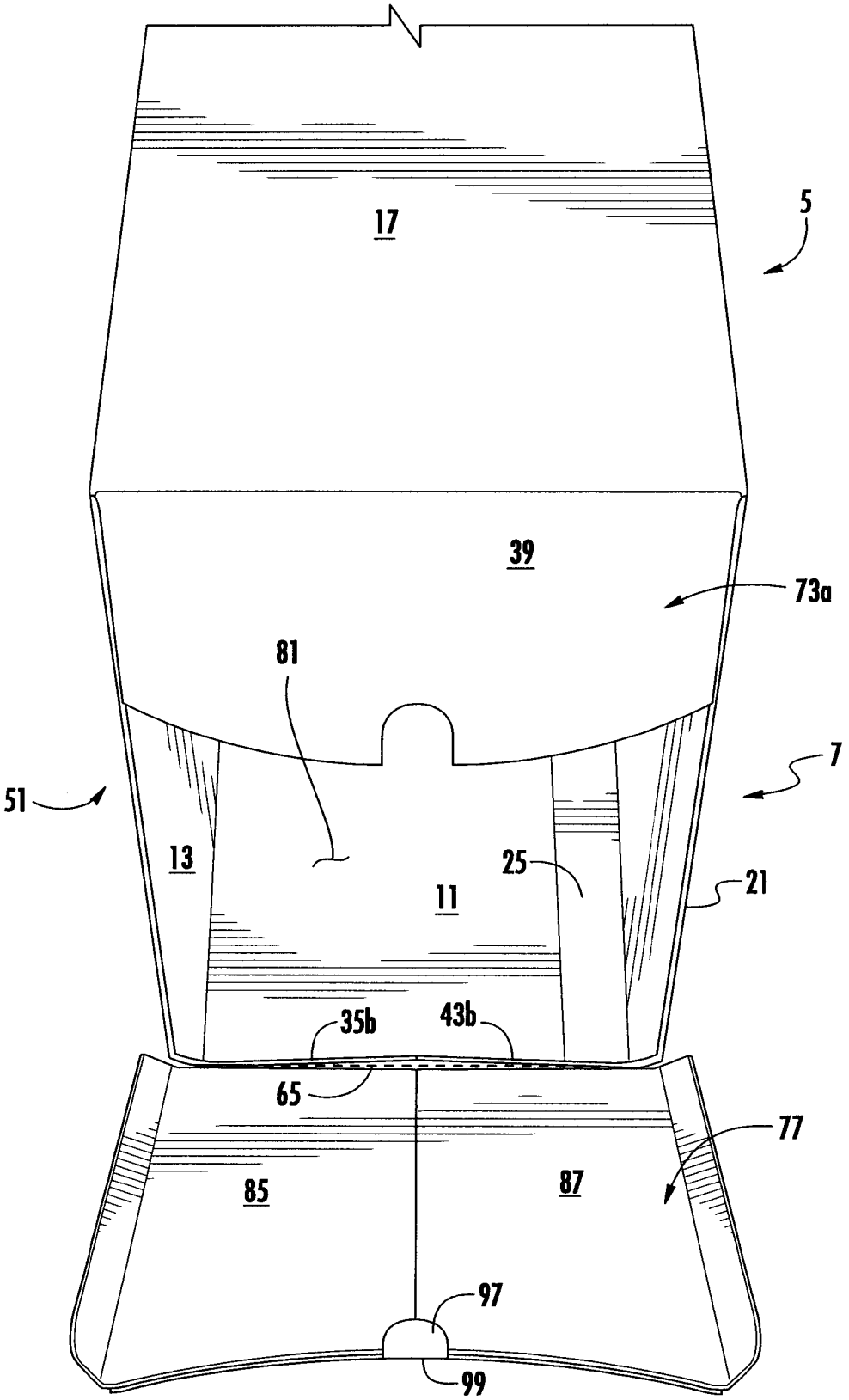
FIG. 4 is a perspective view of an end of the carton of FIG. 2 showing a partially-opened dispenser according to the exemplary embodiment of the disclosure.

In the illustrated embodiment, the dispenser 7 (as shown in FIG. 3) includes a dispenser panel, generally indicated at 77, removably attached to the carton 5 at a tear line, generally indicated at 79. When the dispenser panel 77 is removed from the carton 5, a dispenser opening 81 (FIGS. 4 and 5) is exposed that allows the containers to be selectively dispensed from the carton. As shown in FIG. 1, the dispenser panel 77 includes a first dispenser portion 83 at a distal portion of the first top end flap 39, a second dispenser portion 85 extending in the first side panel 13 and the major side end flap 35*a*, and a third dispenser portion 87 extending in the second side panel 21 and the major side end flap 43*a*. The distal portion 63 of the bottom end flap 31 forms a fourth dispenser portion 89 in the first bottom end flap 31. The dispenser portions 83, 85, 87, 89 at least partially overlap to form the dispenser panel 77 (FIGS. 3-5). The first dispenser portion 83 is defined by a first tear line segment 91 of the tear line 79 in the first top end flap 39, the second dispenser portion 85 is defined by a second tear line segment 93 of the tear line 79 in the first side panel 13 and the major side end flap 35*a*, and the third dispenser portion 87 is defined by a third tear line segment 95 of the tear line 79 in the second side panel 21 and the major side end flap 43*a*. In the illustrated embodiment, the fourth dispenser portion 89 is defined by the tear line 65 connecting the distal portion 63 to the proximal portion 61 of the first bottom end flap 31. Accordingly, the tear line 65 forms a fourth tear line segment of the tear line 79.

As shown in FIG. 1, the first tear line segment 91 further defines an access flap 97, which is foldably connected to the first dispenser portion 83 along a lateral fold line 99. Cutouts 101 also can be formed in the major side end flaps 35*a*, 43*a* so that the cutouts 101 can be aligned with the access flap 97 when the first top end flap 39 overlaps the major side end flaps 35*a*, 43*a* in the closed end 51 of the carton 5. Accordingly, the cutouts 101 can provide clearance for the access flap to be folded inwardly when initiating tearing of the tear line 79 to open the dispenser 7. The dispenser panel 77, the tear line 79, and the access flap 97 could be otherwise shaped, arranged, or configured without departing from the disclosure. Additionally, the dispenser 7 could be omitted or otherwise shaped, arranged, and/or configured without departing from the disclosure.

In the illustrated embodiment, the handle 9 extends in the top panel 17. The handle 9 can be any suitable type of handle, conventional or otherwise. In the illustrated embodiment, the handle 9 comprises an elongate handle flap 103 formed in the top panel 17 and a diamond-shaped crease 105 in the top panel and the first and second side panels 13, 21. The handle flap 103 is foldably attached to the top panel 17 at lateral fold line 107 and is defined by a cut or tear line 109. A lateral fold line 111 bisects the handle flap 103 and diamond-shaped crease 105 and extends across the top panel 17 and into both the side panels 13, 21 to facilitate activation of the handle 9. The handle 9 may be activated by pressing on the handle flap 103 and folding the handle flap down (e.g., inward) to form an opening (not shown) in the carton 5. The opening is shaped for insertion of a user's fingers during grasping of the carton 5. The handle 9 is longitudinally spaced in the top panel 17 such that the handle flap 103 is generally centered in the top panel between the lateral fold lines 57, 59 of the blank 3. It is understood that the handle 9 may be otherwise shaped, arranged, configured, and/or located without departing from the scope of this disclosure. Further, the handle 9 could be omitted without departing from the scope of the disclosure.

In accordance with the exemplary embodiment, the blank 3 can be erected into the carton 5 by folding along fold lines 15, 19, 23, 27 and adhering the adhesive flap 25 to the bottom panel 11 to form an open-ended sleeve (not shown). The ends 51, 53 of the carton 5 can be closed by respectively overlapping and adhering the end flaps 31, 35*a*, 35*b*, 39, 43*a*, 43*b* at one end and the end flaps 33, 37*a*, 37*b*, 41, 45*a*, 45*b* at the other end.

In one embodiment, the second end 53 can be closed first by folding the major side end flaps 37*a*, 45*a* along oblique segments 60*b* of the fold line 59 and the minor side end flaps 37*b*, 45*b* along the lateral segments 60*a* of the fold line 59 over the end of the sleeve. The top end flap 41 is downwardly folded along the fold line 59 so that the proximal portion 67 overlaps the minor side end flaps 37*b*, 45*b* and the distal portion 69 overlaps the major side end flaps 37*a*, 45*a*. The top end flap 41 can be glued to any or all of the minor side end flaps 37*b*, 45*b* or major side end flaps 37*a*, 45*a*. The bottom end flap 33 can be upwardly folded along the fold line 59 to overlap the major side end flaps 37*a*, 45*a*, and the bottom end flap 33 can be glued to one or both of the major side end flaps 37*a*, 45*a*. Accordingly, the proximal portion 67 of the top end flap 41 and the minor end flaps 37*b*, 45*b* form the upper portion 75*b* of the closed end 53 extending from the top panel 17, and the distal portion 69 of the top end flap 41, the major end flaps 37*a*, 45*a*, and the bottom end flap 33 form the oblique portion 75*a* of the closed end 53 extending from the bottom panel 11 to the upper portion 75*b*. As shown in FIG. 2, the upper portion 75*b* extends in a generally vertical direction (e.g., generally perpendicular to the top panel 17), and the oblique portion 75*a* extends at an angle with respect to the upper portion 75*b* (e.g., an at approximately 30 degree angle, or any other suitable angle).

After the second end 53 is closed, the containers C can be inserted into the sleeve (e.g., as shown in FIG. 2), and the first end 51 can be closed. Accordingly, the major side end flaps 35*a*, 43*a* can be folded along the oblique segments 58*b* of the fold line 57 and the minor side end flaps 35*b*, 43*b* can be folded along the lateral segments 58*a* of the fold line 57 over the end of the sleeve. The bottom end flap 31 can be upwardly folded along the fold line 57 so that the proximal portion 61 overlaps the minor side end flaps 35*b*, 43*b* and the distal portion 63 overlaps the major side end flaps 35*a*, 43*a*. The bottom end flap 31 can be glued to any or all of the minor side end flaps 35*b*, 43*b* or major side end flaps 35*a*, 43*a*. The top end flap 39 is downwardly folded along the fold line 57 to overlap the major side end flaps 35*a*, 43*a*, and the top end flap 39 can be glued to one or both of the major side end flaps 35*a*, 43*a*. Accordingly, the proximal portion 61 of the bottom end flap 31 and the minor end flaps 35*b*, 43*b* form the lower portion 73*b* of the closed end 51 extending from the bottom panel 11, and the distal portion 63 of the bottom end flap 31, the major end flaps 35*a*, 43*a*, and the top end flap 39 form the oblique portion 73*a* of the closed end 51 extending from the top panel 17 to the lower portion 73*b*. As shown in FIG. 2, the lower portion 73*b* extends in a generally vertical direction (e.g., generally perpendicular to the bottom panel 11), and the oblique portion 73*a* extends at an angle with respect to the lower portion 73*b* (e.g., at an approximately 30 degree angle, or any other suitable angle). In one embodiment, the proximal portion 61 of the bottom end flap 31 can be overlapped with and glued to the minor side end flaps 35*b*, 43*b* to form the lower portion 73*b* while the major side end flaps 35*a*, 43*a*, the top end flap 39, and the distal portion 63 of the bottom end flap 31 are folded away from the end 51 so that a portion of the opening of the sleeve at the first end remains open. The containers C can be inserted into the sleeve through the opening above the lower portion 73*b*. Accordingly, as the containers C are loaded, the lower portion 73*b* helps retain the containers in the bottom row.

The closed ends 51, 53 could be omitted or otherwise shaped, arranged, and/or configured without departing from the disclosure. For example, the oblique portions 73*a*, 75*a*, the lower portion 73*b*, and the upper portion 75*b* could extend at any suitable angle and/or be any suitable size. In the illustrated embodiment, the laterally-extending free edges of the top end flaps 39, 41 can be disposed adjacent to and/or abut the laterally-extending free edges of the respective bottom end flaps 31, 33 when the ends 51, 53 are closed. Alternatively, the top end flaps 39, 41 and the bottom end flaps 31, 33 can overlap one another and/or be glued to one another. It is understood that closing configurations that differ from the closing configurations discussed herein are within the scope of the disclosure. Further, the containers C could be alternatively loaded into the carton 5. For example, the containers C could be loaded before or after closing any portion of either end 51, 53 of the carton 5.

As shown in FIG. 2, the containers C (shown in phantom) are arranged in three nested rows of six so that the containers C in the upper two rows are generally offset from the respectively lower row by about one half of the characteristic dimension (e.g., diameter D) of the containers C toward the second end 53. The containers C adjacent the second end 53 are supported and/or retained by at least the oblique portion 75*a* of the closed second end 53 (e.g., the containers adjacent the second end 53 can rest on one or both of the major side end flaps 37*a*, 45*a*). The container C adjacent the second end 53 and the top panel 17 can contact the upper portion 75*b*. Additionally, the container C that is adjacent the first end 51 and the bottom panel 11 can be retained and/or supported by the lower portion 73*b* (e.g., the container adjacent the first end 51 and the bottom panel 11 can be in contact with the minor side end flaps 35*b*, 43*b*). The containers C that are adjacent the first end 51 can contact the oblique portion 73*a*. Accordingly, the oblique portion 75*a* of the second end 53 can help bias the containers C toward the first end 51 as containers are removed through the dispenser 7, while the lower portion 73*b* of the first end 51 can help prevent the containers C from undesirably rolling out of the carton 5. In other words, the containers C are at least partially supported by a surface (the oblique portion 75*a* of the second end 53) that is sloped toward the first end 51.

In the illustrated embodiment, the dispenser 7 can be opened to provide access to the containers C through the opening 81 (FIGS. 4 and 5). For example, the access flap 97 in the top end flap 39 can be pushed inwardly, tearing along the tear line segment 91 and folding along the fold line 99 through the cutouts 101 in the major side end flaps 35*a*, 43*a*. A finger can then grasp the interior of the dispenser panel 77 through the opening formed by the access flap 97 in order to pull the dispenser panel 77 outwardly. The pulling on the dispenser panel 77 can tear the tear line 79 along the overlapped portions of the first tear line segment 91 in the top end flap 39 and the second and third tear line segments 93, 95 in the respective major side end flaps 35*a*, 43*a*. The second and third tear line segments 93, 95 can be further torn in the respective side panels 13, 21 as the dispenser portions 83, 85, 87, 89 are pivoted away from the end 51 along the tear line 65 (FIG. 4). In one embodiment, the dispenser panel 77 can remain foldably attached to the end 51 of the carton 5 along the tear line 65 (FIG. 4). Alternatively, the dispenser panel 77 can be fully removed by tearing along the tear line 65 (FIG. 5). The dispenser 7 can be alternatively opened without departing from the scope of the disclosure.

As shown in FIG. 5, the height H of the lower portion 73*b* is generally less than the diameter D of the containers C and more that half the diameter D. Accordingly, the container C on the bottom row adjacent the first end 51 is accessible through the dispenser 7 and the lower portion 73*b* of the first end 51 can retain the containers C in the bottom row. As shown in FIG. 5, the ends of the container C adjacent to the bottom panel 11 and the lower portion 73*b*, and the ends of the container C immediately above it, are accessible at least from the portion of the opening 81 that extends into the side panels 13, 21. A user can easily grasp the ends of one of the containers C through the opening 81 and remove the container from the carton 5. The oblique portion 75*a* of the second end 53 can help bias the containers C towards the first end 51, and therefore a container C that is closer to the top panel 17 or that is farther away from the first end 51 will tend to move into the spot previously occupied by the removed container C. The user can continue to remove containers C this way through the opening 81 as desired. The lower portion 73*b* can help retain or block the container C adjacent the bottom panel 11 and the lower portion 73*b* from rolling out of the carton 5, and this container will help retain the remaining containers C in the carton 5. Since the containers C are nested as shown in FIG. 2, the one container C adjacent the lower portion 73*b* can help retain all the remaining containers C in the carton 5 even when the dispenser 7 is open.

The carton 5 can be carried by grasping the handle 9 in the top panel 17. The carton 5 can be carried by other steps or methods without departing from the disclosure.

The present disclosure can be used in cartons that include various features, including additional opening features that provide easy access to the articles and tilt features that position the articles at the front or rear end of the carton.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A carton for containing a plurality of articles, the carton comprising:

a plurality of panels that extends at least partially around an interior of the carton, the plurality of panels comprising a top panel, a bottom panel, a first side panel, and a second side panel;

at least two end flaps, each end flap of the at least two end flaps being respectively foldably attached to a panel of the plurality of panels along a fold line, the at least two end flaps being at least partially overlapped with respect to one another and thereby at least partially form a closed end of the carton, wherein:

the closed end of the carton comprises a generally vertical portion extending from the bottom panel and an oblique portion extending from the top panel to the generally vertical portion;

the at least two end flaps comprise at least one major side end flap and at least one minor side end flap each foldably connected to at least one of the first side panel and the second side panel, the at least one major side end flap at least partially forms the oblique portion of the closed end of the carton, and the at least one minor side end flap at least partially forms the generally vertical portion of the closed end of the carton;

the at least one major side end flap is foldably connected to the at least one of the first side panel and the second side panel along an oblique segment of the fold line, and the at least one minor side end flap is foldably connected to the at least one of the first side panel and the second side panel along a lateral segment of the fold line; and a dispenser extending in at least the closed end of the carton.

2. The carton of claim 1, wherein the oblique portion of the closed end of the carton at least partially extends over the bottom panel.

3. The carton of claim 1, wherein the at least two end flaps comprise a bottom end flap foldably connected to the bottom panel, the bottom end flap comprises a proximal portion foldably connected to a distal portion, and the proximal portion at least partially forms the generally vertical portion of the closed end of the carton.

4. The carton of claim 3, wherein the at least two end flaps further comprise a top end flap foldably connected to the top panel, the top end flap at least partially overlaps the distal portion of the bottom end flap, and the top end flap and the distal portion of the bottom end flap at least partially form the oblique portion of the closed end of the carton.

5. The carton of claim 4, wherein the at least one major side end flap comprises a first major side end flap and a second major side end flap foldably connected to the respective first side panel and second side panel, the at least one minor side end flap comprises a first minor side end flap and a second minor side end flap foldably connected to the respective first side panel and second side panel, the proximal portion of the bottom end flap at least partially overlaps the first minor side end flap and the second minor side end flap to at least partially form the generally vertical portion of the closed end of the carton, and the top end flap and the distal portion of the bottom end flap at least partially overlap the first major side end flap and the second major side end flap to at least partially form the oblique portion of the closed end of the carton.

6. The carton of claim 5, wherein the dispenser comprises a dispenser panel, at least a first portion of the dispenser panel comprises at least a portion of the top end flap, at least a second portion of the dispenser panel comprises at least a portion of the distal portion of the bottom end flap, at least a third portion of the dispenser panel comprises at least a portion of the first major side end flap, at least a fourth portion of the dispenser panel comprises at least a portion of the second major side end flap, and the first portion, the second portion, the third portion, and the fourth portion of the dispenser panel at least partially overlap to at least partially form the dispenser panel.

7. The carton of claim 6, wherein the third portion of the dispenser panel further comprises at least a portion of the first side panel, and the fourth portion of the dispenser panel further comprises at least a portion of the second side panel.

8. The carton of claim 6, wherein the dispenser further comprises an access flap in the top end flap and foldably connected to the first portion of the dispenser panel, a first cutout in the first major side end flap adjacent the third portion of the dispenser panel, and a second cutout in the second major side end flap adjacent the fourth portion of the dispenser panel, and the access flap is generally aligned with the first cutout and the second cutout.

9. The carton of claim 1, wherein the at least one major side end flap comprises a first major side end flap foldably connected to the first side panel and a second major side end flap foldably connected to the second side panel, the at least one minor side end flap comprises a first minor side end flap foldably connected to the first side panel and a second minor side end flap foldably connected to the second side panel, the first major side end flap and the second major side end flap are at least partially overlapped to at least partially form the oblique portion of the closed end of the carton, and the first minor side end flap and the second minor side end flap are at least partially overlapped to at least partially form the generally vertical portion of the closed end of the carton.

10. The carton of claim 1, wherein the at least two end flaps are at least two first end flaps, the closed end of the carton is a first closed end of the carton, the generally vertical portion is a first generally vertical portion, and the oblique portion is a first oblique portion, the carton further comprising at least two second end flaps foldably attached to respective panels of the plurality of panels, the at least two second end flaps being at least partially overlapped with respect to one another and thereby at least partially form a second closed end of the carton, the second closed end of the carton comprising a second generally vertical portion extending from the top panel and a second oblique portion extending from the bottom panel to the second generally vertical portion.

11. The carton of claim 10, wherein the first oblique portion of the first closed end of the carton at least partially extends over the bottom panel, and the second oblique portion of the second closed end of the carton at least partially extends under the top panel.

12. The carton of claim 10, wherein the at least two second end flaps comprise a top end flap foldably connected to the top panel, the top end flap comprises a proximal portion foldably connected to a distal portion, and the proximal portion at least partially forms the second generally vertical portion of the second closed end of the carton.

13. The carton of claim 12, wherein the at least two second end flaps further comprise a bottom end flap foldably connected to the bottom panel, the bottom end flap and the distal portion of the top end flap are at least partially overlapped, and the bottom end flap and the distal portion of the top end flap at least partially form the second oblique portion of the second closed end of the carton.

14. The carton of claim 13, wherein the at least two second end flaps further comprise a first major side end flap and a first minor side end flap each foldably connected to the first side panel and a second major side end flap and a second minor side end flap each foldably connected to the second side panel, the proximal portion of the top end flap at least partially overlaps the first minor side end flap and the second minor side end flap to at least partially form the second generally vertical portion of the second closed end of the carton, and the bottom end flap and the distal portion of the top end flap at least partially overlap the first major end flap and the second major end flap to at least partially form the second oblique portion of the second closed end of the carton.

15. A carton for containing a plurality of articles, the carton comprising:

a plurality of panels that extends at least partially around an interior of the carton, the plurality of panels comprising a top panel, a bottom panel, a first side panel, and a second side panel:

at least two first end flaps, each first end flap of the at least two first end flaps being respectively foldably attached to a panel of the plurality of panels, the at least two first end flaps being at least partially overlapped with respect to one another and thereby at least partially form a first closed end of the carton, wherein the first closed end of the carton comprises a first generally vertical portion extending from the bottom panel and a first oblique portion extending from the top panel to the first generally vertical portion;

at least two second end flaps, each second end flap of the at least two second end flaps being respectively foldably attached to a panel of the plurality of panels, the at least two second end flaps being at least partially overlapped with respect to one another and thereby at least partially form a second closed end of the carton, wherein:

the second closed end of the carton comprises a second generally vertical portion extending from the top panel and a second oblique portion extending from the bottom panel to the second generally vertical portion; and the at least two second end flaps comprise at least one major side end flap and at least one minor side end flap each foldably connected to at least one of the first side panel and the second side panel, the at least one major side end flap at least partially forming the second oblique portion of the second closed end of the carton, and the at least one minor side end flap at least partially forming the second generally vertical portion of the second closed end of the carton; and a dispenser extending in at least the closed end of the carton.

16. The carton of claim 10, wherein the second oblique portion of the second closed end of the carton is for urging at least a portion of the articles of the plurality of articles toward the first closed end of the carton.

17. The carton of claim 1, wherein each article of the plurality of articles comprises a characteristic dimension, and the generally vertical portion of the closed end of the carton comprises a height that is less than the characteristic diameter.

18. The carton of claim 1, further comprising a handle in at least the top panel.

* * * * *